United States Patent [19]

Schlageter et al.

[11] Patent Number: 4,466,728

[45] Date of Patent: Aug. 21, 1984

[54] DEVICE FOR THE DEVELOPMENT OF CHARGE IMAGES, WHICH ARE ARRANGED ON A CHARGE IMAGE CARRIER, WITH THE AID OF A DEVELOPING MIXTURE CONSISTING OF TONER AND CARRIER PARTICLES

[75] Inventors: Bernhard Schlageter, Ottobrunn; Manfred Maier, Munich, both of Fed. Rep. of Germany

[73] Assignee: Siemens Aktiengesellschaft, Berlin & Munich, Fed. Rep. of Germany

[21] Appl. No.: 375,458

[22] Filed: May 6, 1982

[30] Foreign Application Priority Data

May 13, 1981 [DE] Fed. Rep. of Germany ..... 3119029

[51] Int. Cl.[3] ..... G03G 15/09

[52] U.S. Cl. ..... 355/3 DD; 118/658

[58] Field of Search ..... 355/3 DD, 14 D, 15; 118/652, 653, 656, 657, 658, 602

[56] References Cited

U.S. PATENT DOCUMENTS

| | | | |
|---|---|---|---|
| 3,882,821 | 5/1975 | Katayama et al. . | |
| 3,943,887 | 3/1976 | Smith | 118/658 X |
| 4,030,447 | 6/1977 | Takahashi et al. | 118/658 |
| 4,095,883 | 6/1978 | Parker et al. | 118/657 X |
| 4,168,901 | 9/1979 | Ito et al. | 355/15 X |
| 4,331,184 | 5/1982 | Terashima et al. | 355/3 DD X |

*Primary Examiner*—G. P. Tolin

*Assistant Examiner*—J. Pendegrass

*Attorney, Agent, or Firm*—Hill, Van Santen, Steadman & Simpson

[57] ABSTRACT

In a developer station for an electrophotographic printing or copying machine, there is provided apparatus which serves to effectively prevent toner dust emergence from the lower region of the developer station which could cause undesirable inking of background areas on the charge image carrier passing through the developer station. This apparatus comprises a generally laterally extending guide plate assembly disposed adjacent the open upper end of the developer station and extending between the magnetic drum or developing roller and an adjacent station sidewall. The guide plate is arranged with a lead end facing the discharge point of the inking gap formed between the developing roller and the charge image carrier for dividing developer mix passing from the inking gap and spilling off the upper end of the developing roller into two branch flows, the first of which passes through the gap formed between the lead end of the guide plate and the adjacent developing roller surface and the second of which is conducted from the opposed trail end of the guide plate against the adjacent station sidewall along which it passes back downwardly into the lower region of the station. The guide plate serves as a solid barrier against the emergence of toner dust from the lower region of the station and the two branch flows serve as fluid seals against such upward escape of toner dust.

4 Claims, 1 Drawing Figure

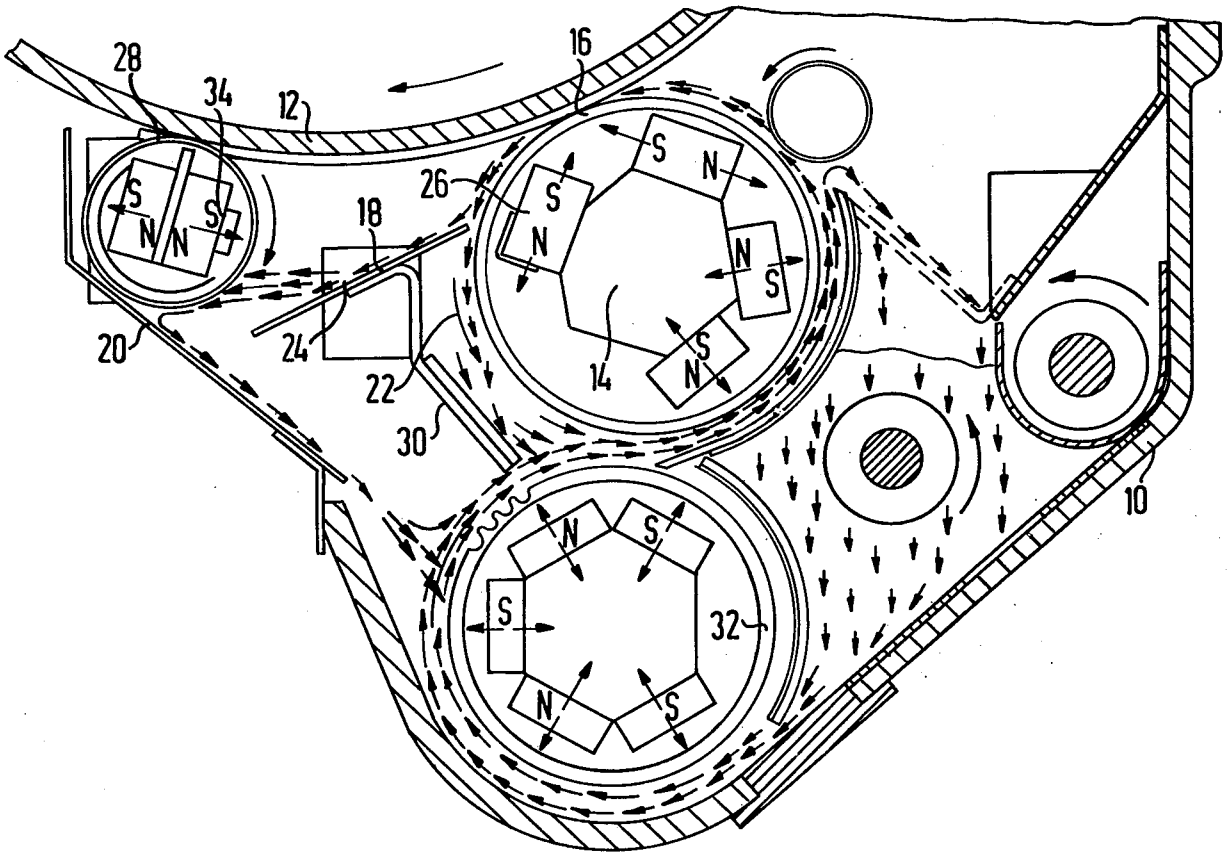
10
12
14
16
18
20
22
24
26
28
30
32
34
N
S

DEVICE FOR THE DEVELOPMENT OF CHARGE IMAGES, WHICH ARE ARRANGED ON A CHARGE IMAGE CARRIER, WITH THE AID OF A DEVELOPING MIXTURE CONSISTING OF TONER AND CARRIER PARTICLES

RELATED APPLICATIONS

This application concerns subject matter which relates to the following commonly assigned U.S. patent applications, all filed May 6, 1982:

Ser. No. 375,457 entitled "Device For Adjusting The Level Of A Developing Mixture Which Consists Of Toner And Carrier Particles On A Developing Roller" and Ser. No. 375,456 entitled "A Developing Station For The Development Of Charge Images."

BACKGROUND OF THE INVENTION

The invention relates to apparatus for use in a developer station where charge images formed in a charge image carrier passed through the developer station are linked in accordance with magnetic brush principles with a developer mix of toner and carrier particles. Typically, non-mechanical printing or copying machines function according to electrophotographic or xerographic principles, wherein electrostatic latent images of characters to be printed are generated on a charge image carrier, such as a photoconductive drum, and subsequently inked with a black powder known as toner in a developing station. The toner images are subsequently transferred to sheet paper on which they are fixed. The developing station typically includes at least one developer unit generally referred to in the art as a magnetic brush developer. The magnetic brush developer, as a rule, contains a magnetic drum mounted for rotation so as to continually bring developer mix, consisting of iron carrier particles and toner particles, into contact with the electrostatic images recorded on the charge image carrier. The change images are inked by adherence of toner particles to the charge images due to electrostatic forces. The magnetic drum conventionally comprises a rotating hollow cylinder with a stationary magnet arrangment mounted within. One known developer station assembly which functions in accordance with magnetic brush principles is disclosed in U.S. Pat. No. 3,882,821.

In the case of rapid data printers or copiers, the charge images are developed at high speeds. For this purpose, the developer mix is continuously transported past the charge image carrier by the magnetic drum, also known as the developing roller. The direction of rotation and the speed of the developing roller are selected to be such that the charge image carrier containing the latent charge images is correspondingly brushed with developer mix particles as the charge images are conducted through the developing station. As the printing speed increases, the rotational speed of the developing roller must be correspondingly increased, which leads to particle dust generation within the developer station and thus undesirable background inking on the charge image carrier.

Background inking may be prevented when lower relative speeds prevail between the charge image carrier and the developing roller. However, in such an arrangement, the quality of inking of the charge images would deteriorate. A further possibility for avoiding background inking would be to increase the diameter of the developing roller; however, this has the disadvantage that the developing roller would become too large for conventional spatial handling in a developer station.

An object of the present invention is to provide a developer station with apparatus such that, even in the case of highspeed printers or copiers, charge images on the charge image carrier can be effectively inked with high resolution and no inking contamination of the background areas on the charge image carrier.

SUMMARY OF THE INVENTION

In a developer station for an electrophotographic printing or copying machine, there is formed an inking gap between the charge image carrier passing through the developer station and the developing roller by which developer mix is conducted upwardly from the housing floor to the inking cap. Adjacent to the developing roller and disposed longitudinally therewith is a guide plate assembly extending generally transversely from the developing roller toward one sidewall of the developer station housing. The lead end of the guide plate is disposed adjacent the inking gap in order to divide the flow of unused developer mix particles passing through the inking gap into two branches. The first branch passes beneath the lead end of the guide plate and generally follows the downward movement of the developing roller, whereas the second branch passes onto the guide plate toward the trail end of the guide plate and a gap formed between the guide plate and the adjacent housing sidewall.

In accordance with the preferred embodiment, a magnetic carrier collecting roller is arranged adjacent the exit end of the developer station where the charge image carrier passes out of the station to retrieve carrier particles which might have become adhered to the charge image carrier surface. In such instances, the trail end of the guide plate extends into the vicinity of the carrier collecting roller, such that the second branch of developing mix becomes directed against the collecting roller for cleaning or stripping carrier and toner particles which become adhered to the surface of the carrier collecting roller.

The guide plate is further preferably provided with a downwardly extending partition member which runs from beneath the guide plate to a lower region of the developer station substantially along the adjacent surface of the developer roller. The partition member serves to prevent toner particles contained in the first branch flow from passing laterally into other regions of the developer station. In instances when a transport roller is provided in the developer station to transport developer mix from the floor of the housing to the developing roller, the lower end of the partition member is disposed in the vicinity of the upper surface of the transport roller. Thus, the first branch of unused developer mix is then directly guided onto the transport roller.

BRIEF DESCRIPTION OF THE DRAWING

The sole FIGURE is a schematic, side elevational cross-sectional view of a developer station constructed in accordance with the present invention.

DESCRIPTION OF THE PREFERRED EMBODIMENT

The FIGURE illustrates a developer station 10 for use in an electrophotographic printing or copying machine. A charge image carrier 12 in the form of a photoconductive drum is mounted for rotation in the machine in the direction indicated by the arrow for conducting charge images from suitable charging stations (not shown) to the developer station 10 for inking, and then to suitable transfer and cleaning stations (not shown).

The developer station 10 is formed of a housing having an open upper end facing toward the moving surface of the charge image carrier drum 12. A magnetic or developer drum 14, which may be of conventional construction, is disposed for rotation in the housing for conducting developer mix particles, consisting of toner and iron carrier particles, from a lower region of the housing to an inking gap 16 formed between the developer roller 14 and the charge image carrier 12 in the direction of the arrows shown. The developer roller 14 comprises, for example, a rotating hollow cylinder and a stationary, fixed magnet assembly which is arranged inside the hollow cylinder. That portion of the developer mix carried by the developer drum 14 which does not adhere to the carrier drum 12 spills off under the influence of gravity from the upper end of the drum 14 downstream of the inking gap 16. In this manner, developer mix, which has been substantially depleted of toner particles during the inking process in the inking gap 16, is returned to the lower region of the developer station.

In the case of high printing speed operation, the developer roller 14 likewise operates at a high speed. The rapid rotation of the developer drum generates toner particle break-up which, in the form of a dust generation, leads to undesirable background inking on the charge image carrier. In order to avoid such undesirable background inking, a guide plate assembly 24 is disposed adjacent to and longitudinally extending with the developer roller 14. The guide plate 18 is formed with a lead end which is disposed adjacent the upper end of the developer roller 14 in the vicinity downstream of the inking gap 16 and a trail end which is disposed toward, but stopping short of the exit end sidewall 20 of the developer station housing. The guide plate 18 extends generally laterally away from the developer roller 14 and serves to divide developer mix spilling off the upper end of the developer drum into first and second branch flows 22 and 24, respectively.

The first branch flow 22 passes beneath the lead end of the guide plate 18 generally along the path of downward movement of the developing roller 14. The second branch flow 24 passes onto the lead end of the guide plate 18 over which it is conducted toward the housing wall 20. Upon leaving the trail end of the guide plate 18, the second branch mix flow drops downward toward the lower region of the developer station. In this manner, the guide plate 18 serves to seal or partition off the lower region of the developer station 10 from communication with the exposed charge image carrier surface passing from the inking gap 16, except for the lead end gap formed between the developing roller 14 and the plate 18 and the trail end gap formed between the plate 18 and the adjacent housing wall 20, such that toner dust is prevented from escaping from the lower region of the developer station into contact with the charge image carrier 12. The possibility of toner dust passing through the two gaps formed at the opposed ends of the guide plate 18 is effectively minimized due to the developer mix branch flows 22 and 24 which run in directions counter to the emergence of toner dust from the developer station lower region.

In order to promote the flow of developer mix particles along the path 22, a fixed magnet 26 is arranged within the hollow cylinder of the developing roller 14 so as to be adjacent to the lead end of the guide plate 18. The magnet 26 serves to draw developer mix particles through the gap formed between the plate 18 and the developer roller 14.

In some developer station arrangements, a carrier collecting roller 28 is disposed for rotation at the exit end of the developer station from which the charge image carrier 12 emerges. Such a carrier collecting roller 28 may comprise a hollow cylinder mounted for rotation in a direction opposite to that of the direction of movement of the charge image carrier 12 and a fixed magnet assembly 34 disposed inside the rotating cylinder. The carrier collecting roller 28 serves to remove carrier particles which may have become adhered to the charge image carrier 12 in the inking gap 16. Preferably, in accordance with the invention, the trail end of the guide plate 18 is disposed adjacent to a lower surface portion of the carrier collecting roller 28, such that the second branch flow 24 of mixed particles is disposed to pass against the lower end of the carrier collecting roller 28 off the guide plate 18. By virtue of the magnet assembly 34 of the carrier collecting roller 28, the second branch flow 24 is drawn toward the lower end of the carrier collecting roller and this flow serves to clean, by means of an absorbing or stripping process, any carrier or toner particles which may have been retrieved from the charge image carrier 12 by the collecting roller 28. Due to the velocity of the second branch flow, this flow picks up particles arising on the carrier collecting roller 28 and continues to pass toward the housing wall 20 and downward for return to the lower region of the developer station. In this manner, the carrier collecting roller 28 is permanently cleaned and service cleaning is no longer required. Further, the path of the second branch flow between the guide plate 18 and the carrier collecting roller 28 serves to seal the lower region of the developer station 10 from the charge image carrier 12 such that toner dust is unable to emerge from the lower region past the trail end of the guide plate 18 and into contact with the exposed portion of the carrier surface.

Extending substantially downwardly from beneath the guide plate 18, there is preferably provided a partition wall member 30 which runs toward the lower region of the developer station along the surface of the developing roller 14. The wall member 30 is directed generally vertically and extends the width of the guide plate 18 longitudinally with the developing roller 14. The partition member 30 serves to separate the first branch flow 22 from particles in the second branch flow 24 passing along the housing wall 20 and, at the same time, serves to direct the first branch flow 22 as it spills off the developing roller 14 toward the lower region of the developer station 10.

In instances when the developer station 10 contains a transport roller 32, disposed for rotation within the lower region of the developer station for conducting developer mix particles from the floor of the developer station to the developing roller 14, the lower end of the wall member 30 extends toward the upper end of the transport roller 32 at a point prior to the region where mixed particles conducted by the transport roller 32 are passed onto the developing roller 14. In this manner, the first branch flow 22 of mixed particles is disposed to fall directly onto the upper end of the transport roller 32 so as to be directly recycled to the developing roller 14 by movement of the transport roller. The transport roller is conventionally of a type comprising a rotating hollow cylinder having an annularly etched surface with a fixed magnet arrangement disposed therein.

Accordingly, the presence of the generally laterally extending guide plate assembly 18 adjacent the open upper end of the developer station housing in cooperation with the magnet means 26 in the developing roller 14 and the adjacent positioning of the housing wall 20 and, preferably, the carrier collecting roller 28, achieves a seal barrier between the charge image carrier 12 and the lower region of the developer station containing toner dust particles. The branch flows 22 and 24 of developer mix particles passing from the inking gap serves to provide a fluid seal against the emergence of toner dust from the lower region of the developer station within the gaps formed at the opposed ends of the guide plate 18. In addition, the disposition of the guide plate 18 relative to the carrier collecting roller 28 serves to provide a cleaning flow of mixed particles against the surface of the carrier collecting roller 28.

Although various minor modifications may be suggested by those versed in the art, it should be understood that we wish to embody within the scope of the patent warranted hereon all such modifications as reasonably and properly come within the scope of our contribution to the art.

We claim as our invention:

1. In a developer station having a housing formed with an upper open end for facing a charge image carrier passing through said station and containing a body of developer mix including toner and carrier particles and a rotary developer drum for conducting developer mix from said body to an inking gap between said developer drum and said carrier for developing charge images generated on said carrier, apparatus for preventing the emergence of mix dust from within said housing through said open upper end comprising:

a guide plate extending generally laterally between said developer drum and an upstanding housing sidewall, said guide plate having a lead end disposed adjacent the developing drum downstream of said inking gap and a trail end disposed adjacent said housing sidewall, said lead end dividing developer mix passing through said inking gap on said developer drum into a first branch flow passing between said lead end and said developer drum and a second branch flow along said guide plate passing between said trail end and housing sidewall, and a fixed magnet means disposed in said developer drum adjacent said lead end for promoting the flow of developer mix in said first branch flow.

2. The apparatus of claim 1, further comprising a rotatable collecting roller disposed in said open upper end adjacent said housing sidewall for retrieving carrier particles from said image carrier, said trail end disposed adjacent the lower end of said collecting roller for directing said second branch flow thereagainst.

3. The apparatus of claim 1, further comprising a wall member extending downwardly from said guide plate along said developing drum for partitioning said first and second branch flows.

4. The apparatus of claim 3, further comprising a rotatable transport roller disposed in said housing beneath said developer drum for conducting developer mix from said body to said developer drum, the lower end of said wall member extending toward the upper end of said transport roller for passing said first branch flow onto said transport roller.

* * * * *